US009302751B1

(12) United States Patent
De La Vega

(10) Patent No.: US 9,302,751 B1
(45) Date of Patent: Apr. 5, 2016

(54) SWIM VEST WITH RECOILING WATER PISTOL ATTACHMENT AND SIPHON TUBE

(71) Applicant: Alberto N. De La Vega, Paramount, CA (US)

(72) Inventor: Alberto N. De La Vega, Paramount, CA (US)

( * ) Notice: Subject to any disclaimer, the term of this patent is extended or adjusted under 35 U.S.C. 154(b) by 16 days.

(21) Appl. No.: 14/481,784

(22) Filed: Sep. 9, 2014

Related U.S. Application Data

(60) Provisional application No. 61/875,946, filed on Sep. 10, 2013.

(51) Int. Cl.
*B63C 9/08* (2006.01)
*B63C 9/11* (2006.01)
*F41B 9/00* (2006.01)

(52) U.S. Cl.
CPC .... *B63C 9/11* (2013.01); *F41B 9/00* (2013.01)

(58) Field of Classification Search
CPC ..... B63C 9/00; B63C 9/08; B63C 9/11; B63C 9/13; F41B 9/00
USPC ..... 441/80, 88, 106, 108, 111–120, 125
See application file for complete search history.

(56) References Cited

U.S. PATENT DOCUMENTS 6,296,540 B1 * 10/2001 LaPlaca ..... A63H 23/00 446/75
2006/0060603 A1 * 3/2006 Firth ..... F41B 9/0084 222/79
2012/0298676 A1 * 11/2012 Cooks ..... B65D 1/04 220/592.21

* cited by examiner

*Primary Examiner* — Daniel V Venne
(74) *Attorney, Agent, or Firm* — Plager Schack LLP

(57) ABSTRACT

Some embodiments of the present disclosure include a multipurpose swim vest for keeping a user safe around a body of water while also providing the user with entertainment. The swim vest may include a swim vest configured to accommodate a user's torso, a water pistol removably attached to vest fabric of the swim vest, the water pistol having a toy tube extending therefrom, a vest tube positioned within a channel in the swim vest, the vest tube extending from a position proximate to a user's side through the channel and out of a bottom surface of the swim vest, and a siphon tube attached to the vest tube. Water may be siphoned through the siphon tube, the vest tube, and the toy tube into the water pistol when the user pulls a trigger on the water pistol, which may also cause water to squirt out of the water pistol.

10 Claims, 3 Drawing Sheets

SWIM VEST WITH RECOILING WATER PISTOL ATTACHMENT AND SIPHON TUBE

RELATED APPLICATION

This application claims priority to provisional patent application U.S. Ser. No. 61/875,946 filed on Sep. 10, 2013, the entire contents of which is herein incorporated by reference.

BACKGROUND

The embodiments herein relate generally to swim apparel and accessories, and more particularly, to a swim vest with a recoiling water pistol attachment and a siphon tube.

Many individuals wear swim vests or life jackets to keep them safe while swimming or otherwise around a body of water. However, some people, particularly children, find swim vests to be boring and easily detached, resulting in the child complaining about wearing the swim vest or taking it off when an adult is not paying attention.

Additionally, individuals, particularly children, enjoy playing with water pistols, water guns, or other water squirting toys when around bodies of water. However, conventional water squirting toys have to be constantly refilled, which can be difficult for children to do.

Therefore, what is needed is a multipurpose swim vest with a recoiling water pistol attachment or other water squirting toy attachment having a siphon tube, thus adding entertainment to the swim vest while simultaneously removing the need to constantly fill the water toy.

SUMMARY

Some embodiments of the present disclosure include a multipurpose swim vest for keeping a user safe around a body of water while also providing the user with entertainment. The swim vest may include a swim vest configured to accommodate a user's torso, a water pistol removably attached to vest fabric of the swim vest, the water pistol having a toy tube extending therefrom, a vest tube positioned within a channel in the swim vest, the vest tube extending from a position proximate to a user's side through the channel and out of a bottom surface of the swim vest, and a siphon tube attached to the vest tube. Water may be siphoned through the siphon tube, the vest tube, and the toy tube into the water pistol when the user pulls a trigger on the water pistol, which may also cause water to squirt out of the water pistol.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used simultaneously as a swim vest and as a water squirting toy and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Swim Vest
2. Water Squirting Attachment
3. Siphon Tube

The various elements of the multipurpose swim vest for keeping an individual safe and providing an individual with entertainment of the present disclosure may be related in the following exemplary fashion. It is not intended to limit the scope or nature of the relationships between the various elements and the following examples are presented as illustrative examples only.

Figure 1:
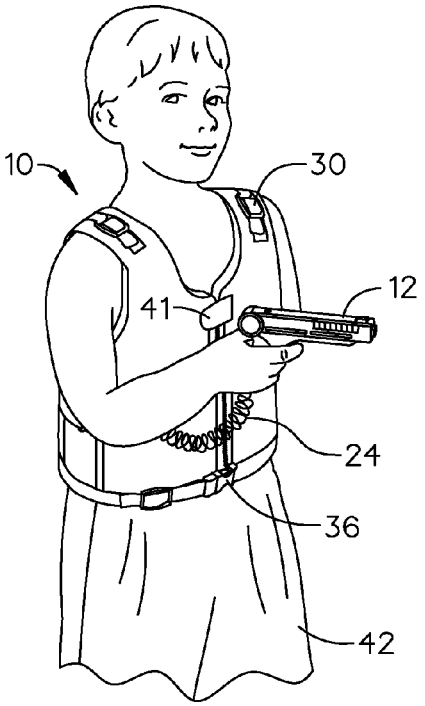
FIG. 1 is a perspective view of one embodiment of the present invention, shown in use.
Figure 2:
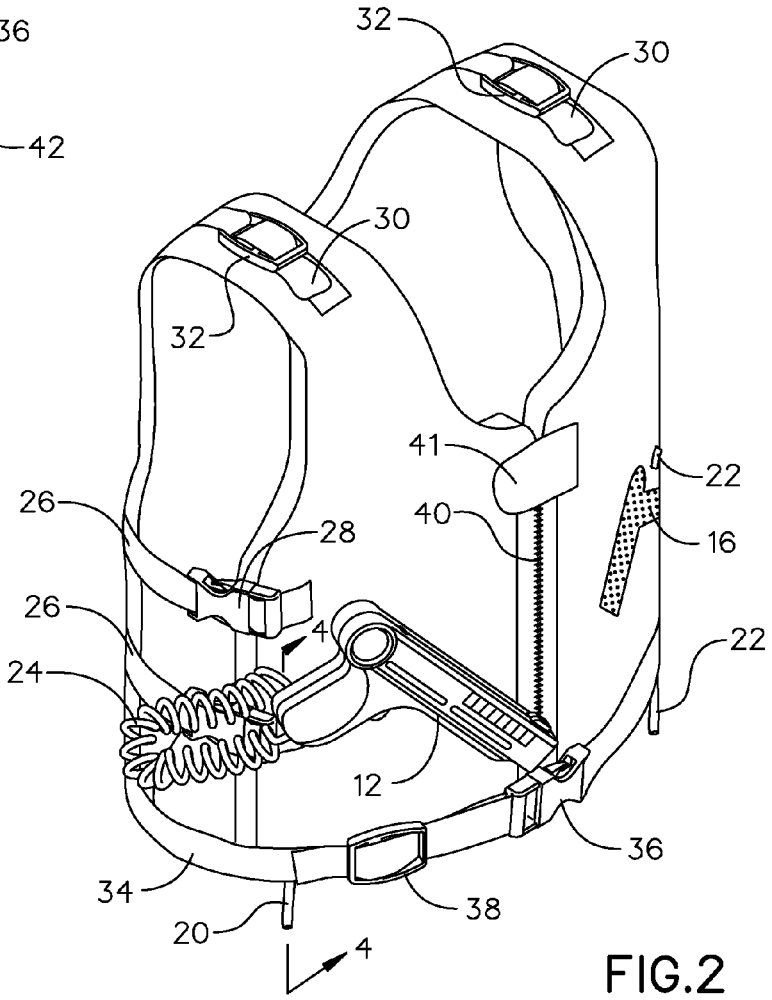
FIG. 2 is a perspective view of one embodiment of the present invention.
Figure 3:
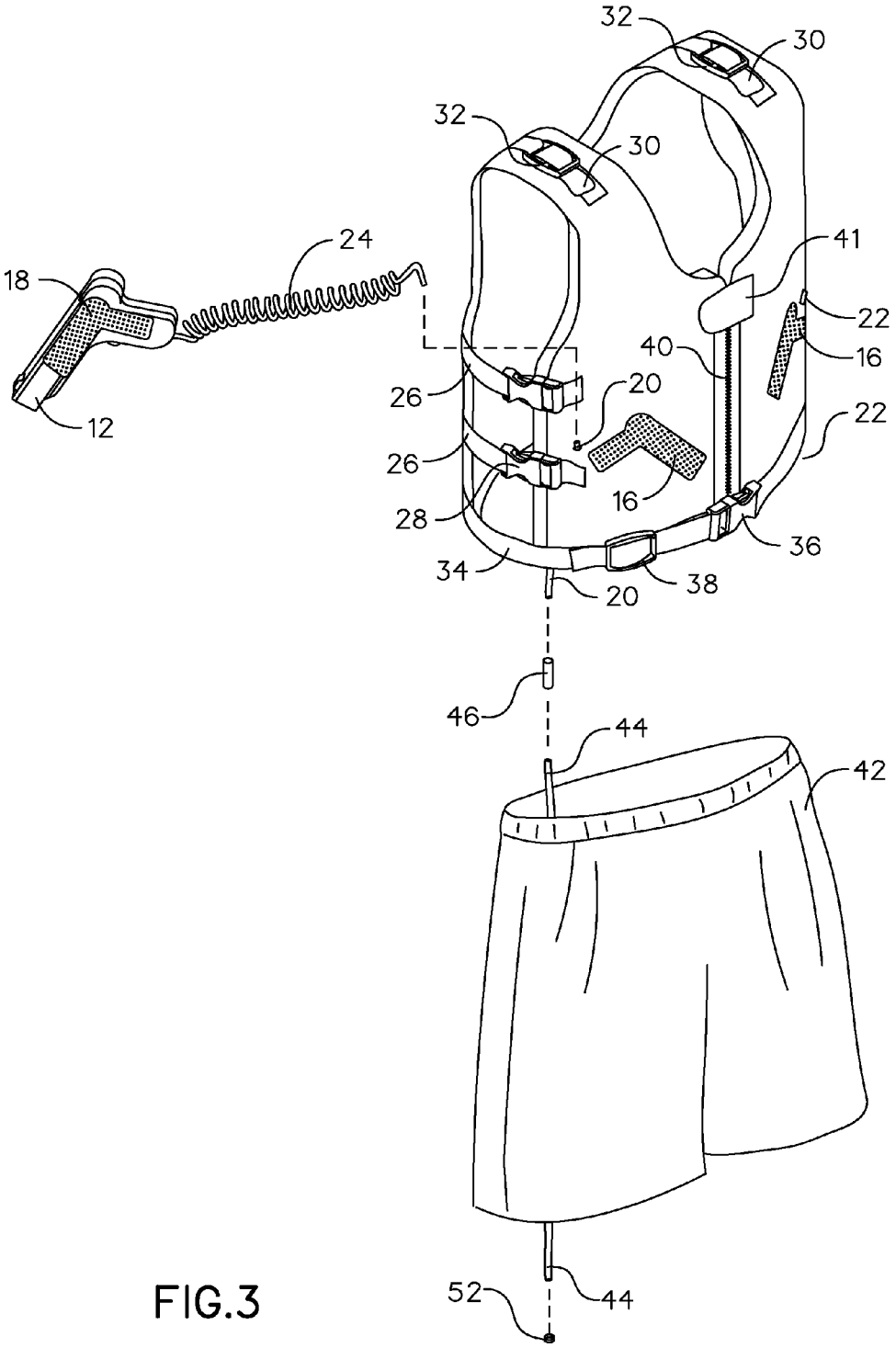
FIG. 3 is an exploded view of one embodiment of the present invention.
Figure 4:
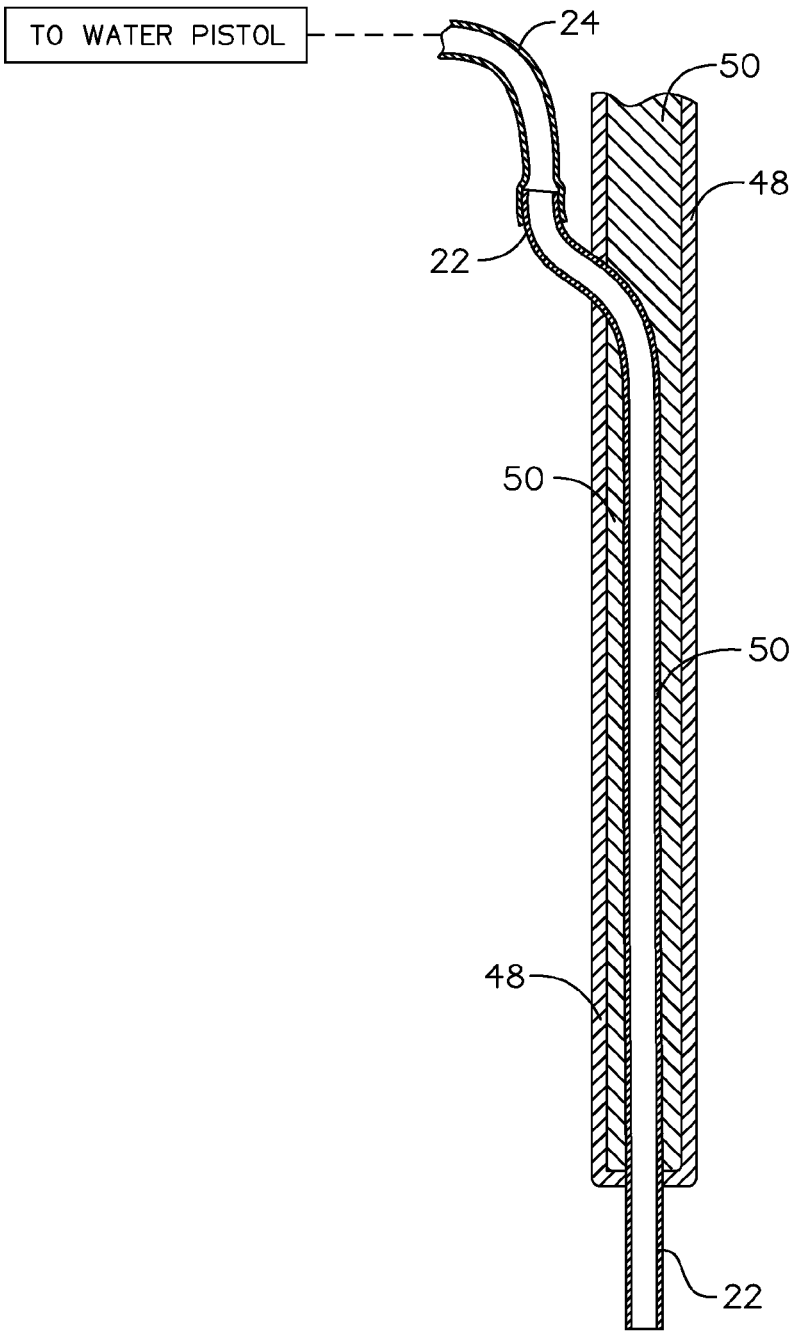
FIG. 4 is a section view of one embodiment of the present invention, taken along line 4-4 in FIG. 2.

By way of example, and referring to FIGS. 1-4, some embodiments of the multipurpose swim vest of the present disclosure comprise a swim vest 10 configured to accommodate a user's torso; a water squirting toy, such as a water pistol 12, removably attached to the vest fabric 48 of the swim vest 10, the water squirting toy having a toy tube, such as a coiled tube 24 extending therefrom; a vest tube, such as a right vest tube 20 or a left vest tube 22, positioned within a channel in the vest foam 50 of the swim vest 10, the vest tube extending from a position proximate to a user's side through the channel and out of a bottom surface of the swim vest 10; and a siphon tube, such as shorts tube 44, attached to the vest tube, wherein the siphon tube extends into the water, and water is configured to be pulled up from a body of water through the siphon tube, vest tube, and toy tube into the water squirting toy when the user pulls a trigger or other mechanism on the water squirting toy, which also forces water to squirt out of the toy. As shown in FIGS. 2 and 3, the swim vest 10 may comprise a plurality of water squirting toys, such as two water squirting toys, attached thereto, wherein the water squirting toys comprise a surface having a fastener, such as a hook fastener 18, configured to engage with a fastener, such as a loop fastener 16, on the swim vest 10 to attach the water squirting toys to the swim vest 10. Hook and loop fastener is merely one example of a suitable fastener configured to removably attach the water squirting toys to the swim vest 10 and, in other embodiments, the fastener may comprise any conventional fastener, such as buttons, snaps, ties, straps, and the like.

In embodiments, the siphon tube may attach to the vest tube using any suitable mechanism and, in some embodiments, attaches to the vest tube using a two way adapter 46. Similarly, the toy tube may attach to the vest tube using any conventional connector. As shown in FIG. 3, the siphon tube may comprise a shorts tube 44 configured to extend from the waist band of a pair of swim shorts 42 to the leg opening on the swim shorts 42. In some embodiments, the swim shorts 42 may comprise a mechanism, such as a channel or a conventional fastener, such as straps or hook and loop fastener, to removably attach the shorts tube 44 to the swim shorts 42. In other embodiments, the siphon tube may simply comprise a tube extending downward from the bottom surface of the swim vest 10 to the body of water, such that at least an end of the siphon tube distal from the swim vest 10 is in the water. In embodiments, the end of the siphon tube that is inserted into the water may comprise a filter cap with a screen 52, which may prevent unwanted objects from flowing up with the water into the siphon tube, resulting in the tube becoming clogged.

The swim vest 10 may comprise any conventional swim vest. In some embodiments, the swim vest 10 comprises a swim vest that does not have straps and buckles that extend across the front of a user's torso. Rather, as shown in FIGS. 2 and 3, the swim vest 10 may comprise a plurality of side straps 26 with side quick release buckles 28 and a belt 34 with a belt buckle 38 and a belt quick release buckle 36 configured to wrap around a user's waist proximate to a bottom surface of the swim vest 10, the side straps 26 and belt 34 configured to secure and tighten the swim vest 10 to a user's body. The swim vest 10 may also comprise a pair of shoulder straps 30 with shoulder buckles 32 configured to tighten and secure the swim vest 10 to a user's torso. Thus, because of the positioning of the straps, the swim vest 10 may comprise a suitable surface to which the water squirting toys may be attached, as shown in FIG. 3, without the straps interfering with the fasteners for the water squirting toys. Additionally, the swim vest may comprise a zipper 40 with a sipper cover flap 41 extending down the length of the swim vest 10, the zipper 40 configured to secure the swim vest 10 to a user's torso without interfering with the fasteners for the water squirting toys.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A multipurpose swim vest for keeping a user safe around a body of water while also providing the user with entertainment, the swim vest comprising:

a swim vest configured to accommodate a user's torso;

a water squirting toy removably attached to vest fabric of the swim vest, the water squirting toy having a toy tube extending therefrom;

a vest tube positioned within a channel in the swim vest, the vest tube extending from a position proximate to a user's side through the channel and out of a bottom surface of the swim vest; and a siphon tube attached to the vest tube, wherein the siphon tube extends from the vest tube into the water, and water is configured to be siphoned from a body of water through the siphon tube, the vest tube, and the toy tube into the water squirting toy when the user pulls a trigger on the water squirting toy, which is also configured to cause water to squirt out of the water squirting toy.

2. The multipurpose swim vest of claim 1, wherein:

the water squirting toy comprises a water pistol; and the tube extending from the water pistol comprises a coiled tube.

3. The multipurpose swim vest of claim 1, wherein the vest tube is connected to the siphon tube using a two way adapter.

4. The multipurpose swim vest of claim 1, wherein a surface of the water squirting toy comprises a faster configured to engage with a fastener on a surface of the swim vest.

5. The multipurpose swim vest of claim 4, wherein:

the fastener on the water squirting toy comprises a member selected from the group consisting of a hook fastener and a loop fastener; and the fastener on the surface of the swim vest comprises the other member selected from the group consisting of a hook fastener and a loop fastener.

6. The multipurpose swim vest of claim 1, wherein the swim vest comprises a plurality of water squirting toys removably attached thereto.

7. The multipurpose swim vest of claim 1, wherein the swim vest comprises:

a plurality of side straps with side quick release buckles positioned proximate to a user's side, but not extending across the torso of the user; and a belt with a belt buckle and a belt quick release buckle configured to wrap around a user's waist proximate to a bottom surface of the swim vest, wherein:

the side straps and belt and configured to secure and tighten the swim vest to a user's body without interfering with the water squirting toy attachment.

8. The multipurpose swim vest of claim 1, wherein the siphon tube comprises a shorts tube configured to extend from the vest tube downward through a pair of swim shorts into a body of water.

9. A multipurpose swim vest for keeping a user safe around a body of water while also providing the user with entertainment, the swim vest comprising:

a swim vest configured to accommodate a user's torso;

a pair of water pistols removably attached to vest fabric of the swim vest using a hook and loop fastener, the water pistols each having a coiled tube extending therefrom;

a left vest tube and a right vest tube positioned within a left channel and right channel in the swim vest, respectively, each of the vest tubes extending from a position proximate to a user's side through the respective channel and out of a bottom surface of the swim vest; and a shorts tube attached to each of the vest tubes, wherein the shorts tube extends from the vest tube through a pair of swim shorts and into the water, wherein:

water is configured to be siphoned from a body of water through the shorts tube, the vest tube, and the toy tube into the water squirting toy when the user pulls a trigger or on the water pistol, which is also configured to cause water to squirt out of the water pistol.

10. The multipurpose swim vest of claim 9, wherein the swim vest comprises:

a plurality of side straps with side quick release buckles positioned proximate to a user's side, but not extending across the torso of the user; and a belt with a belt buckle and a belt quick release buckle configured to wrap around a user's waist proximate to a bottom surface of the swim vest, wherein:

the side straps and belt and configured to secure and tighten the swim vest to a user's body without interfering with the water pistols.

* * * * *